US008341921B2

(12) United States Patent
Bodnar

(10) Patent No.: US 8,341,921 B2
(45) **Date of Patent: *Jan. 1, 2013**

(54) FLOOR SYSTEM WITH STEEL JOISTS HAVING OPENINGS WITH EDGE REINFORCEMENTS AND METHOD

(75) Inventor: Ernest R Bodnar, Burlington (CA)

(73) Assignee: 1455454, Mississauga, CA (US)

( * ) Notice: Subject to any disclaimer, the term of this patent is extended or adjusted under 35 U.S.C. 154(b) by 402 days.

This patent is subject to a terminal disclaimer.

(21) Appl. No.: 12/585,174

(22) Filed: Sep. 8, 2009

(65) Prior Publication Data

US 2010/0037551 A1 Feb. 18, 2010

Related U.S. Application Data

(63) Continuation-in-part of application No. 11/020,242, filed on Dec. 27, 2004, now abandoned.

(51) Int. Cl.
*E04C 3/00* (2006.01)

(52) U.S. Cl. ..... 52/842; 52/846

(58) Field of Classification Search ..... 52/837, 52/842, 846, 481.1

See application file for complete search history.

(56) References Cited

U.S. PATENT DOCUMENTS

| | | | | |
|---|---|---|---|---|
| 1,235,636 A | | 8/1917 | Bagnall | |
| 2,177,277 A | | 10/1939 | Burke | |
| 2,185,384 A | * | 1/1940 | Rafter | 52/636 |
| 2,185,475 A | | 1/1940 | Rafter | |
| 3,083,794 A | * | 4/1963 | Stovall, Jr. | 52/364 |
| 3,147,570 A | | 9/1964 | Shanton | |
| 4,909,007 A | | 3/1990 | Bodnar | |
| 5,566,522 A | | 10/1996 | Alander | |
| 5,964,071 A | | 10/1999 | Sato | |
| 6,708,459 B2 | | 3/2004 | Bodnar | |
| 2002/0134036 A1 | | 9/2002 | Daudet | |

* cited by examiner

*Primary Examiner* — Basil Katcheves

(74) *Attorney, Agent, or Firm* — Dowell & Dowell, P.C.

(57) ABSTRACT

A steel joist member for use in supporting floor structures giving great strength and convenience and improved acoustical performance having a web defining edges, first and second side surfaces and an axis, a edge wall on at least one edge, main openings through the web at spaced intervals thereal-ong, with rounded ends and parallel linear sides, channel portions of the web displaced from the main openings remaining attached integrally to the web by right angle bend lines formed on the first side surface of the main opening along axes parallel to the web axis, and forming reinforcing channels alongside the opposite sides of the main opening.

Also disclosed is a composite joist member made up of two such joist members joined together back to back with their openings in registration.

Also disclosed is a rim member for supporting the composite joists to form a floor structure.

Also disclosed is a method of making such a floor joist member.

Also disclosed is a floor panel system by which floor panels can be prefabricated in a factory and transported to a construction site ready for installation in a building.

16 Claims, 15 Drawing Sheets

FLOOR SYSTEM WITH STEEL JOISTS HAVING OPENINGS WITH EDGE REINFORCEMENTS AND METHOD

This application is a Continuation in Part of U.S. application Ser. No. 11/020,242 Filed Dec. 27, 2004 now abandoned title FLOOR SYSTEM WITH STEEL JOISTS HAVING OPENINGS WITH EDGE REINFORCEMENTS AND METHOD, Inventor, Ernest R Bodnar

FIELD OF THE INVENTION

The invention relates to a floor system having steel joists each joist being formed of an integral one piece strip of sheet metal, and sheet metal rim members supporting the joists, the joists and rim members being formed with openings, and having edge reinforcements formed around the openings. In particular the openings in the joists are formed with linear reinforcement U-shaped channel formations along opposite sides of the openings, which are formed with bends at respective first and second angles with respect to the plane of the joist.

BACKGROUND OF THE INVENTION

Sheet metal Steel joists of a wide variety have been proposed for erecting floor structures. Usually such joists are used to replace wooden joists. Sheet Metal joists having solid webs have been used, but the webs interfere with the space between the floor and the ceiling beneath. Such joists usually were formed as of sheet metal as a C-section, ie there was a central web, and the opposite side edges of the web were formed into edge flanges. Several such bends were sometime incorporated in an effort to get greater strength, while using thinner gauge sheet metal. Services such as plumbing wiring and HVAC were obstructed by such joists Accordingly metal joists have been proposed which are formed with openings, usually generally triangular or trapezoidal openings, in the web, while the two edges of the joists were formed with bends, as before. These openings were positioned so as to define diagonal struts extending across the joists. In this way it was hoped to achieve strength while reducing weight and obstruction. However because the openings in the metal joists were of these specialized generally triangular or trapezoidal shapes, the services, in many cases conduits of substantial diameter, could not fit through the openings. It was not possible for the builder to cut away any of the diagonal struts to provide larger openings for services, since this would drastically reduce the strength of the sheet metal joists.

The shape of these openings tended to restrict the size of the conduits which could be passed through the joists.

Another problem arose in that the triangular openings were formed with edge flanges around their perimeter. Where these edge flanges extended around an angular corner of the opening there was a tendency for the sheet metal to crack. Consequently the corners had to be radiussed or rounded out. This meant that there was more metal at each of the corners, and the size of the openings was reduced. Another problem arose in cutting these joists to length. The openings were arranged in pairs with one triangle facing one way and the next triangle facing the opposite way. Cutting such joists to length requires that all of the openings of a particular orientation, in all of the adjacent joists in a floor, shall line up. This was required to facilitate passing of services through the openings in the joists. However due to the alternating orientation of the triangular openings this requirement resulted in cutting off end portions of sheet metal joists equal in length to the space occupied by two of the openings, in many cases. Forming such sheet metal joists with alternating triangular openings, requires that the openings be formed repeatedly along the joist. However at each end, the joist web must be a solid piece of sheet metal and free of openings. This required specialized machines which could punch the openings in the sheet metal, repeatedly but which could be controlled so as to "miss" one or more openings, leaving a length of the sheet metal web, solid, and available for cutting to length.

Another factor is that concrete is in wide use for pouring a floor slab.

Usually the slab was simply supported on top of the joists. It is now found that when portions of the metal joists are partially embedded in the concrete, they provide much greater strength to the slabs. Slabs can thus be thinner than in the past, saving material, time, and weight.

It has now been surprisingly found that the use of the specialized triangular or trapezoidal shapes of these joist openings, is unnecessary.

Reduction in weight is possible, by the use of the invention, it is possible to make sheet metal joists with regular symmetrical generally oval-shaped openings, with end portions of the opening being defined by a semi-circular radius. The remainder of the opening is defined by opposite parallel linear edges.

The resulting openings are thus of a somewhat extended oval shape, with linear sides. Solid portions of the sheet metal web remain, between adjacent openings and form sheet metal struts extending transversely from one edge to the other of the web. This avoids the diagonal struts of earlier joists. This also means that the size of the conduits passed through the openings can be increased. The openings substantially span the distance across the web, between the edge flanges of the joist. By the use of the invention it is now possible to form sheet metal joists with openings which can accept conduits having a diameter equal to the distance across the web opening between the edge flanges of the joist.

This is a great improvement over the earlier triangular opening and diagonal strut configuration.

Openings with semi-circular or radiussed ends avoid the problems caused by the corners of the triangular or trapezoidal openings and splitting of metal, and results in a much stronger joist. The use of openings with semi-circular ends greatly facilitates high speed manufacture of such joists. The openings are of identical footprint along the sheet metal web. This means that cutting the sheet metal joist to length becomes possible at shorter intervals, and there is less joist length lost in the process.

The joists with such openings define service pathways for cylindrical service conduits. In each joist the conduit diameter can be equivalent to the distance across the joist between one side edge of the opening and the other, transversely across the joist. This means that the conduits can pass through any opening in the joist, regardless of the orientation of the opening in the joist. This greatly reduces wastage of sheet metal during manufacture.

Much larger conduits can be accepted.

Another factor is earlier designs was the thought that it was essential to remove as much metal as possible. This was considered desirable to improve acoustical performance and avoid transmission of sound from one floor to the next. It has now been found that this was incorrect and unnecessary, at least for making sheet metal joists. What is required is a joist with openings which leave larger openings and more symmetrical openings without loss of strength. It has also now been found that the opposite parallel linear edges of each opening can be greatly strengthened by removing less sheet metal at each opening, rather than more. This surprising development results in leaving an additional piece of sheet metal along side each of the linear edges. These additional pieces are formed, in accordance with the invention, into two generally right angular bends, resulting in two additional U-shaped reinforcing channel structures along the opposite linear sides of each opening in the joist. Preferably both right angular bends are formed spaced apart from each other, so as to define a U shaped reinforcing channel with side walls in parallel planes spaced from one another, and a web at right angles to the side walls extending between the side walls. This greatly reinforces and increases the strength of the joist in the critical area of the extended linear edges of each opening. The fact that more metal remains in the joist does not cause either thermal or acoustical problems, since the extra metal, which is not removed, is simply displaced in a location alongside the opening.

The blanks of sheet metal removed in this process, are of a size and shape which leads to economies in the process since the blanks are smaller. Slug ejection problems in the manufacturing machinery are reduced and there is less wastage of metal.

The semi-circular ends of the openings reduce the problems for the builder who wishes to pass service conduits through the joists within the floor. Much larger diameter conduits can now be fed through the joists, than was possible before. This leads to less sales resistance due to a greater acceptance of the product in the market place.

The shape of the openings is symmetrical and identical.

All the various edges and U shaped reinforcing channels are formed on one side of the sheet metal, leaving the opposite side of the sheet metal smooth and unobstructed and planar. This makes it possible to align the joists in pairs and to place them back to back, with their smooth planar sides in contact with one another, and with their respective edges and U shaped reinforcing channels extending outwardly on opposite sides of the pair of joists.

This arrangement makes stronger composite joists while still maintaining the full size of the openings through the joists, for passing services.

These features can be used in joists having special embedment edge formations for embedment in concrete.

The features can also be used in forming much heavier duty joists with the edge formations formed into a triangular tube shape.

Such joists enable to formation of a floor system with rim members located on a wall structure, and with the joists extending across the space between opposite rim members.

The rim members will also be formed with openings of the type described above. Such rim members will also provide support flanges for supporting opposite ends of the joists. Where a concrete slab floor is to be poured such rim members will incorporate embedment formations for embedment in the slab.

Fastening tabs extend from the rim members, for fastening to the ends of the joists. Abutments may be formed on the rim members to engage opposite sides of the web of each joist to give greater strength.

It will be appreciated that this sheet metal joist, which improves on all these problems associated with prior joists, will have application in general use, for many various construction applications. In particular however it will have advantages in the construction of floors with joists acting as reinforcement for thin-shell concrete slabs.

Such joists can also be used to form floors having a panel surface such as plywood panels.

The joists and rim members may be associated together in accordance with the method described. Preferably the assembly of the rim members and joists, and also the pouring of concrete in some cases, will be done in a factory away from the building site. The floor can be prefabricated in sections, with each section being a composite of a concrete panel, with sheet metal joists embedded by their edges in the panel, and giving it reinforcement. When transported to the site the composite floor sections or panels will simply be lifted into place and fastened together to form the complete floor in the building.

BRIEF SUMMARY OF THE INVENTION

With a view to achieving the foregoing and other objectives the invention comprises an integral one piece sheet metal steel joist member, for use in floor system, formed of a single integral piece of sheet steel, and having a web defining side edges and an axis, and first and second side surfaces, a edge flange on at least one side edge of the web, bent at an angle and extending from said first side, identical symmetrical openings formed through said web at spaced intervals therealong, of predetermined size and profile, with rounded ends and linear sides parallel to one another, channel portions around said openings and remaining attached integrally to said web along opposite linear sides of the opening, a first bend formed in each said channel portion, whereby said channel portion is displaced from said web, a second bend formed in each said channel portion parallel to and spaced from said first bend, said first and second bends being formed along axes parallel to said web axis, an intermediate channel portion extending between said web and said second bend, whereby to form said channel portions into channels of generally U shape in section extending out from said first side of said web, whereby said second side of said web remains smooth and free of obstructions.

The invention further seeks to provide an integral one piece sheet metal steel joist member as described including depressions formed in said web at spaced intervals to increase strength, and openings formed in said depressions to provide further reduction in sound and heat transfer.

The invention further seeks to provide a steel joist member as described wherein said main openings are of a shape defining opposite parallel linear side edges, and arcuate end edges, said side portions of said web being integral with said linear side edges, and continuous edge flanges formed all around said openings. The invention also provides a composite joist member formed of two steel joists as described being attached back to back to one another to form a composite joist member. In this embodiment because the shape of the openings is symmetrical and identical, composite joists can be made simply by placing two joists back to back with their openings in registration with one another. Such composite joists have great strength, while still permitting the passing of services.

The invention also provides a rim member for attachment on a structure around a floor, and supports on said rim member for supporting opposite ends of each steel joist member.

The rim member may also incorporate fastening tabs for fastening to each steel joist member.

The rim member may also incorporate embedment formations, and also joist end abutments.

The invention also provides a method of making a steel joist member having a web and side edges, and a flange along at least one said side edge, and openings through said web, said method comprising the steps of, forming openings having opposed linear parallel sides and arcuate ends in said web at spaced intervals therealong, leaving side portions of metal attached to said web along each of said opposed linear sides, forming said edge flange along said at least one side edge of said web, and, forming said side portions out of the plane of said web by bending each said side portion along a first bend line and then along a second bend line spaced from and parallel to said first bend line. The invention also provides a method of forming a floor joist system, using rim members and steel joist members described above.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

Figure 1:
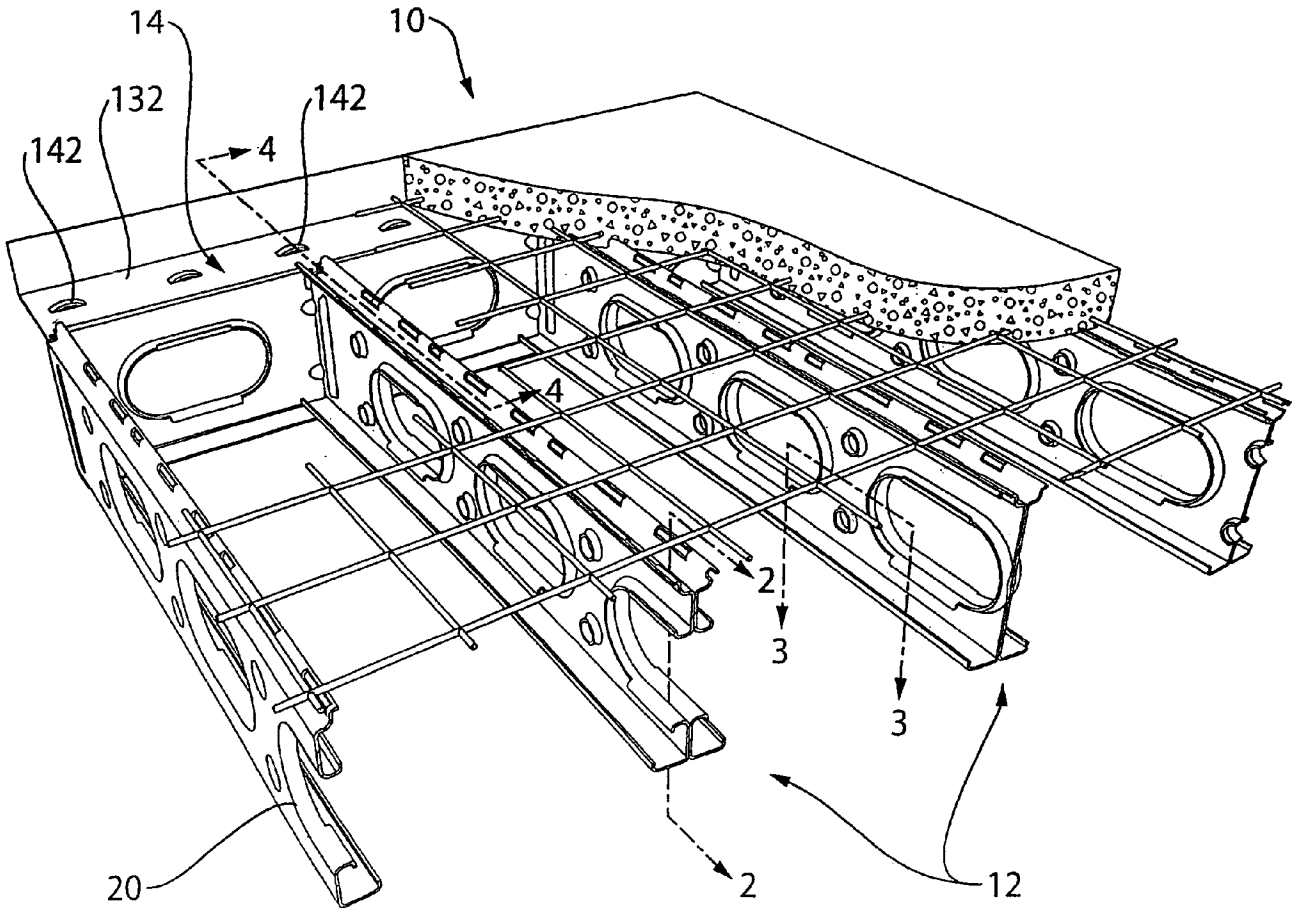
FIG. 1 is a perspective illustration of a floor system illustrating one embodiment of the invention, having composite joists formed of two steel joist members in which the openings have opposite linear sides and semi-circular or arcuate ends, and channels formed on said opposite linear sides of the openings.
Figure 5:
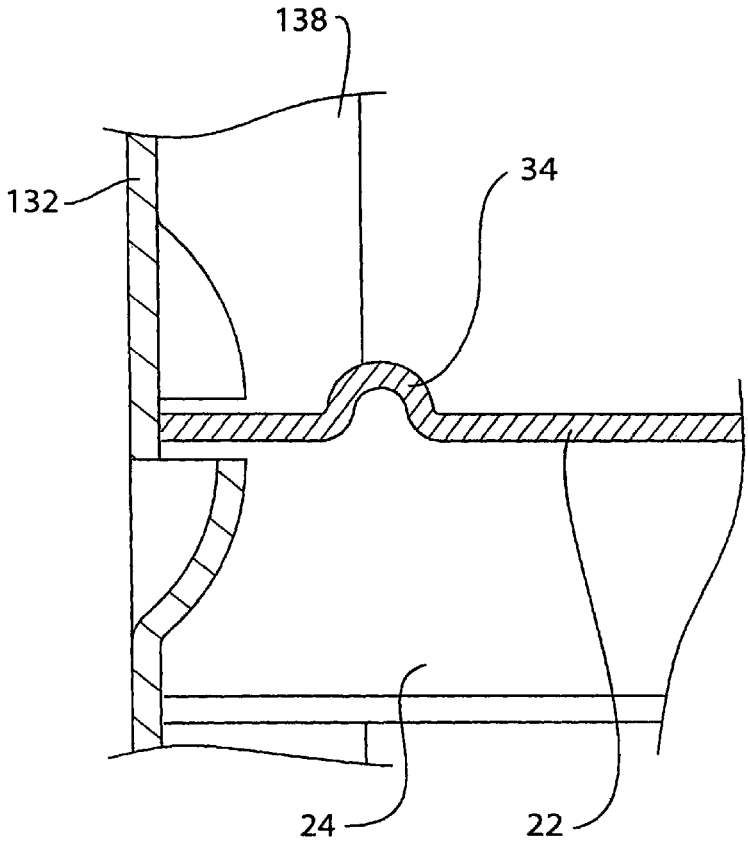
Figure 6:
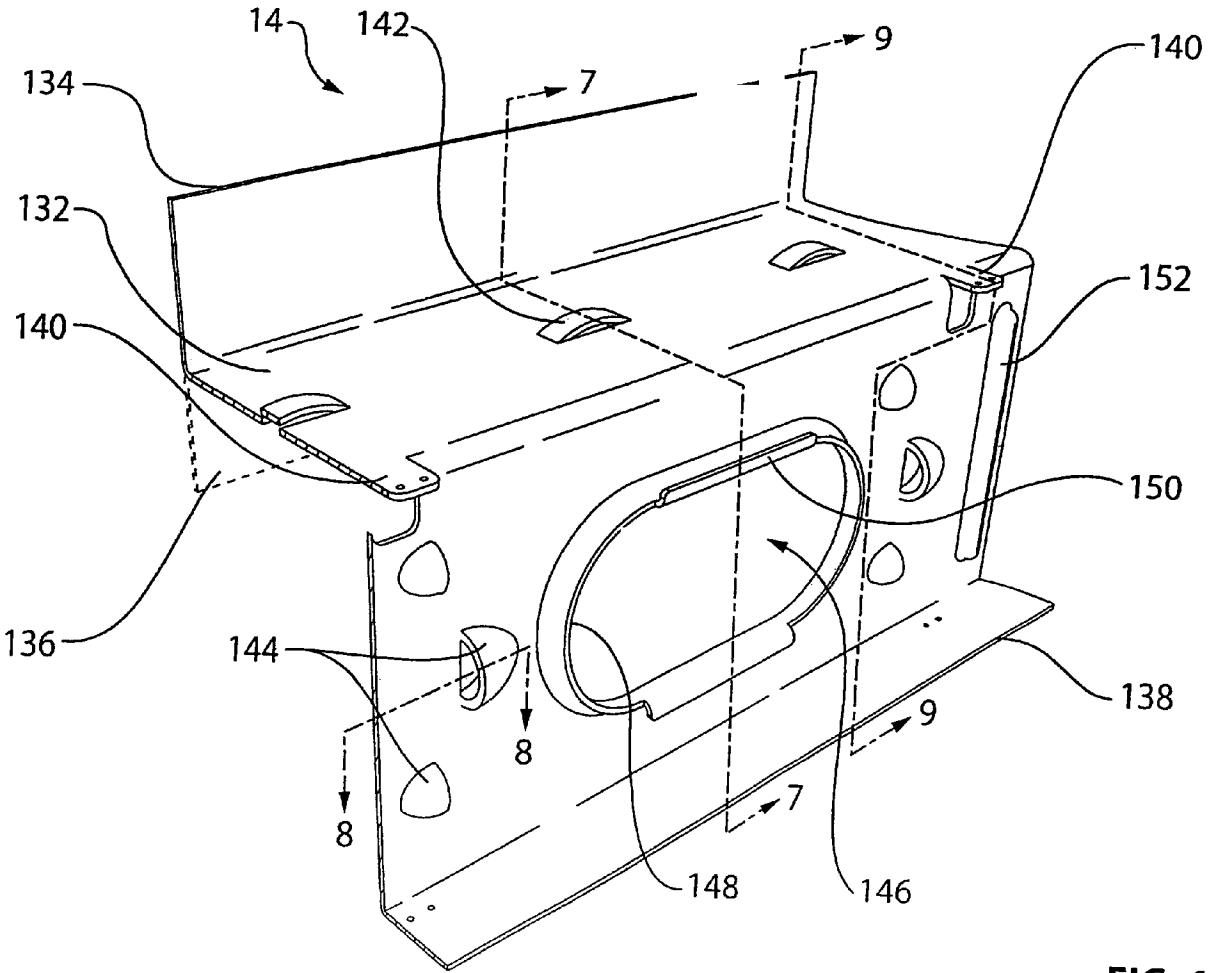
Figure 7:
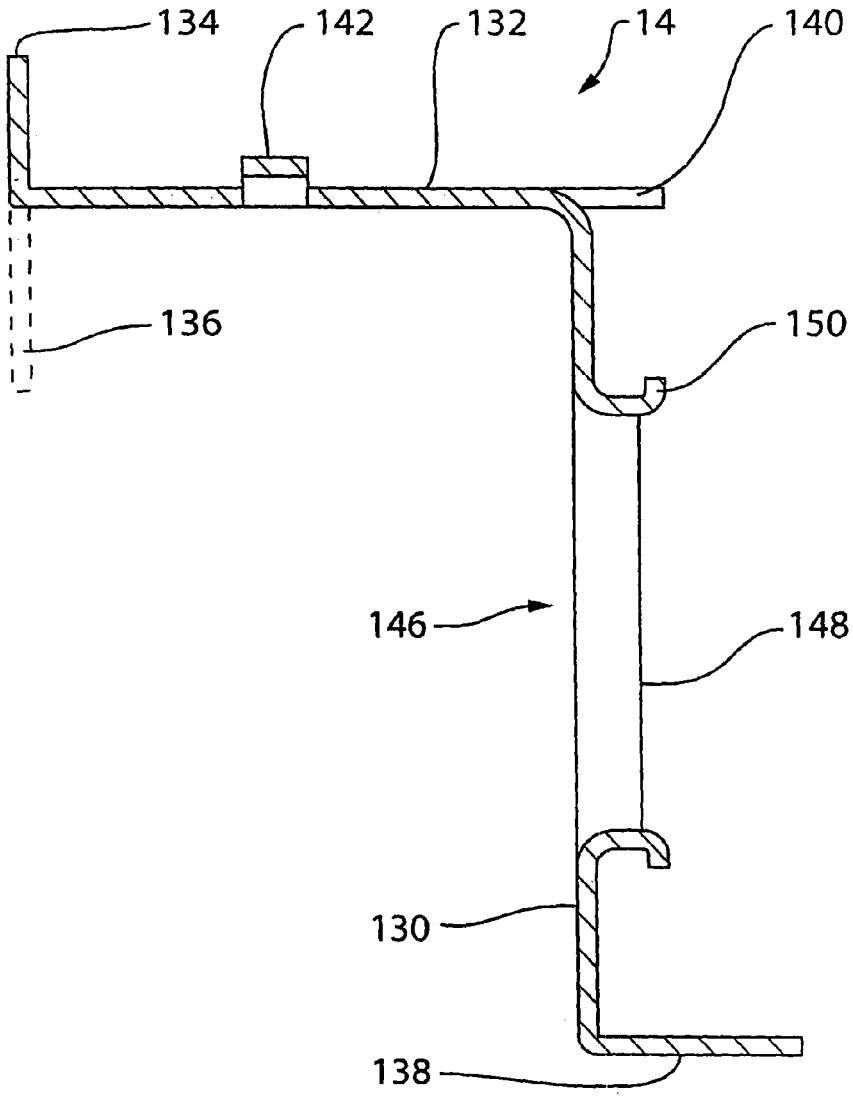
Figure 8:
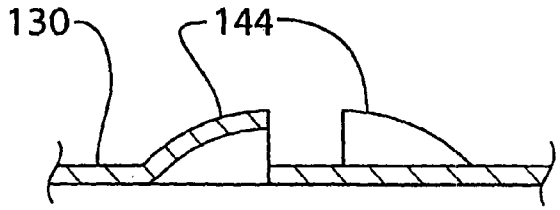
Figure 9:
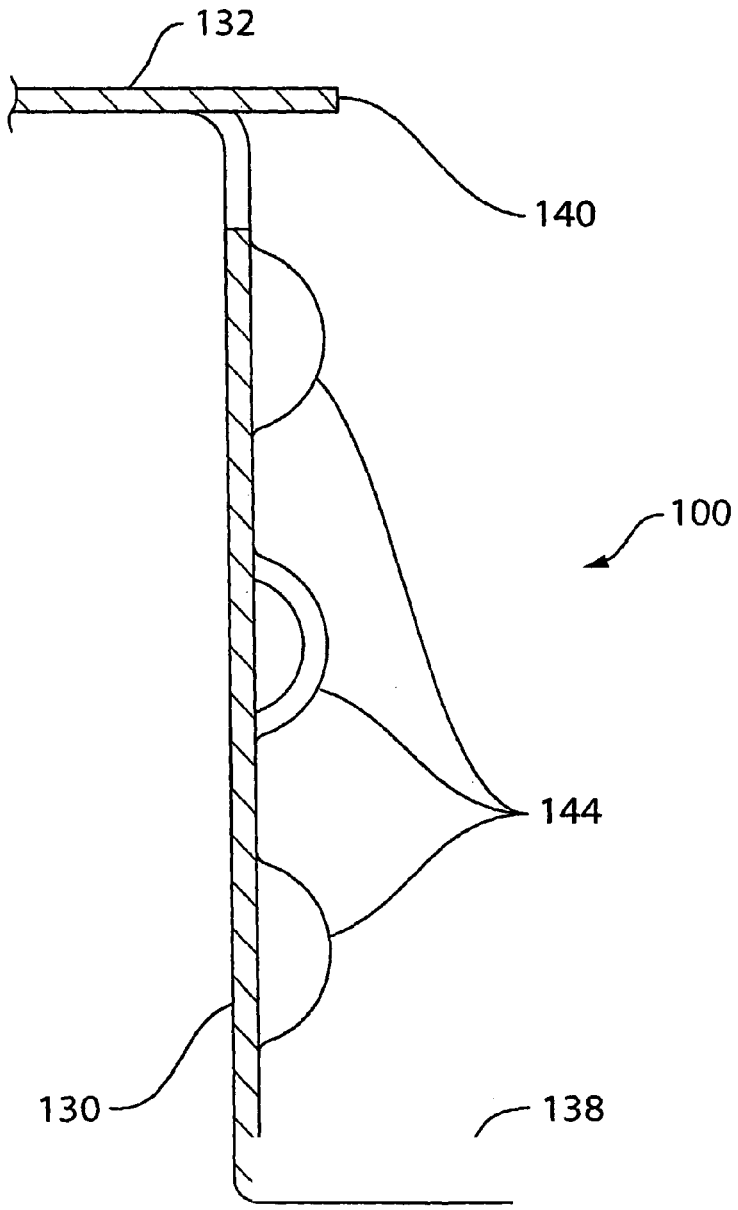
Figure 10:
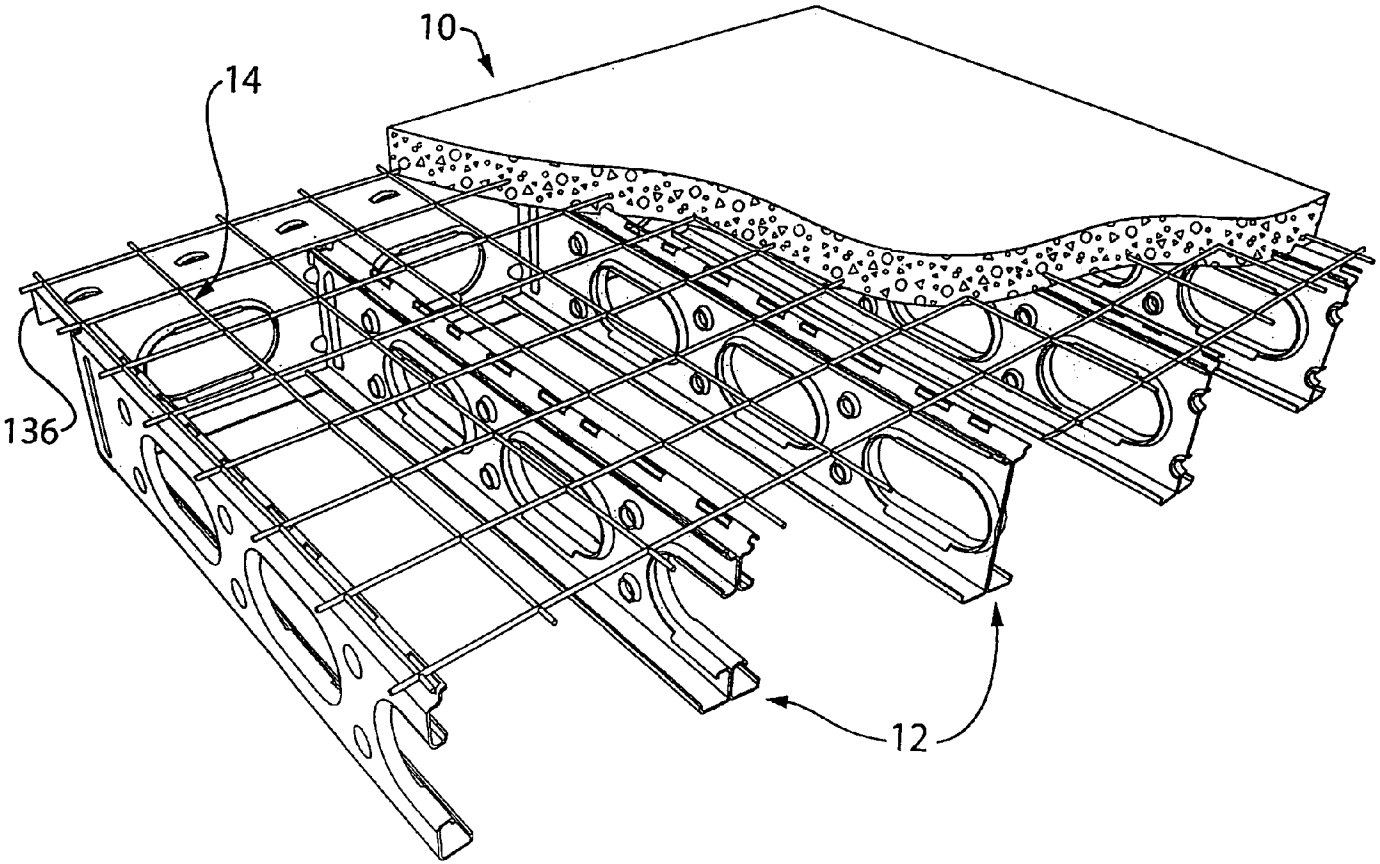
Figure 11:
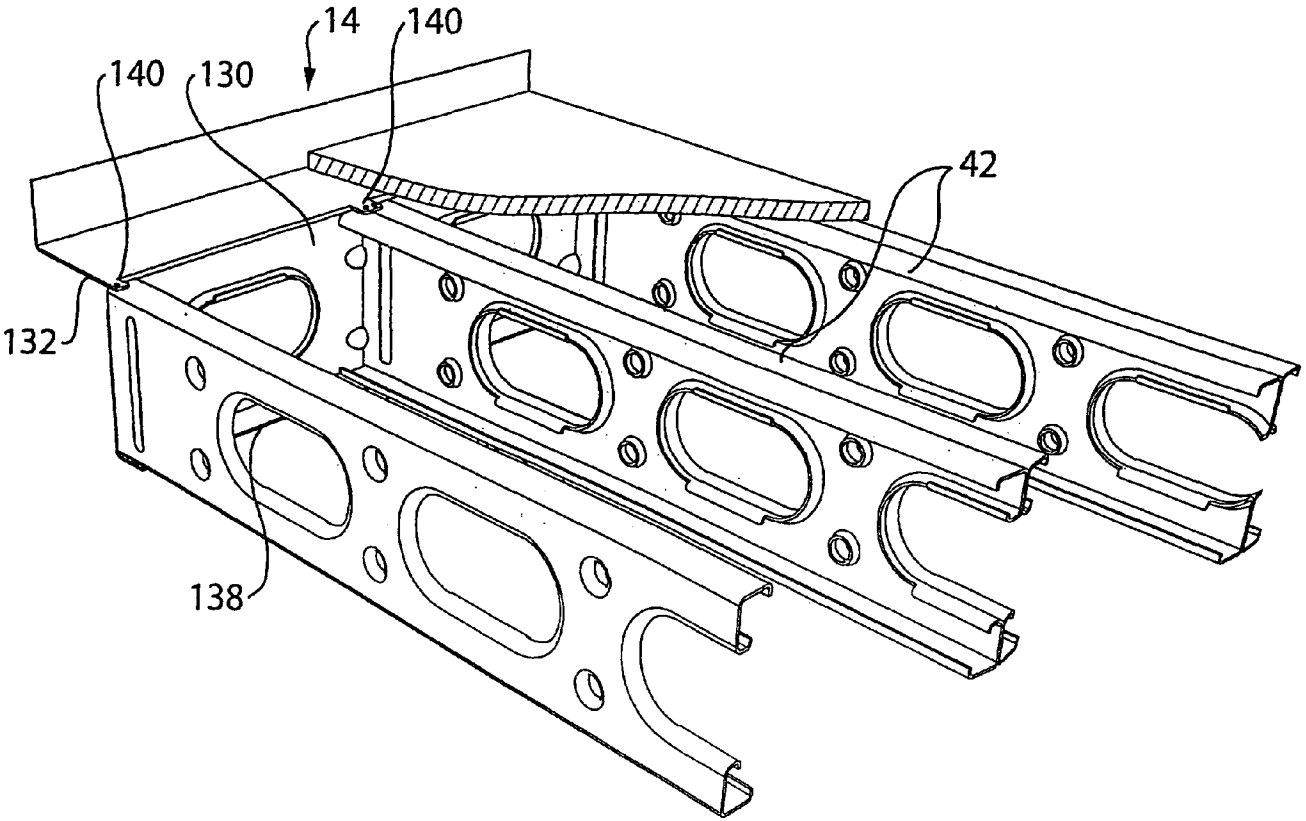
Figure 12:
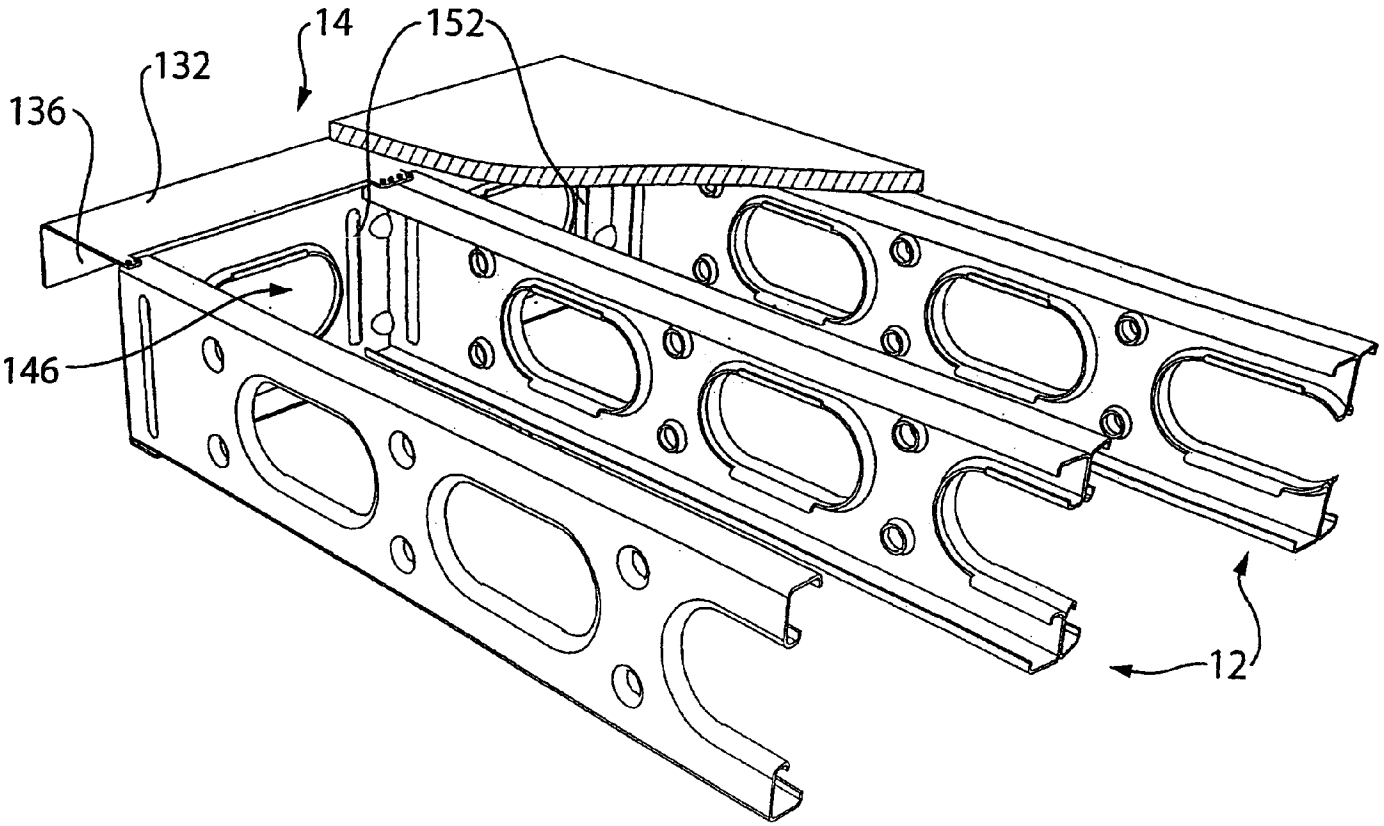
Figure 13:
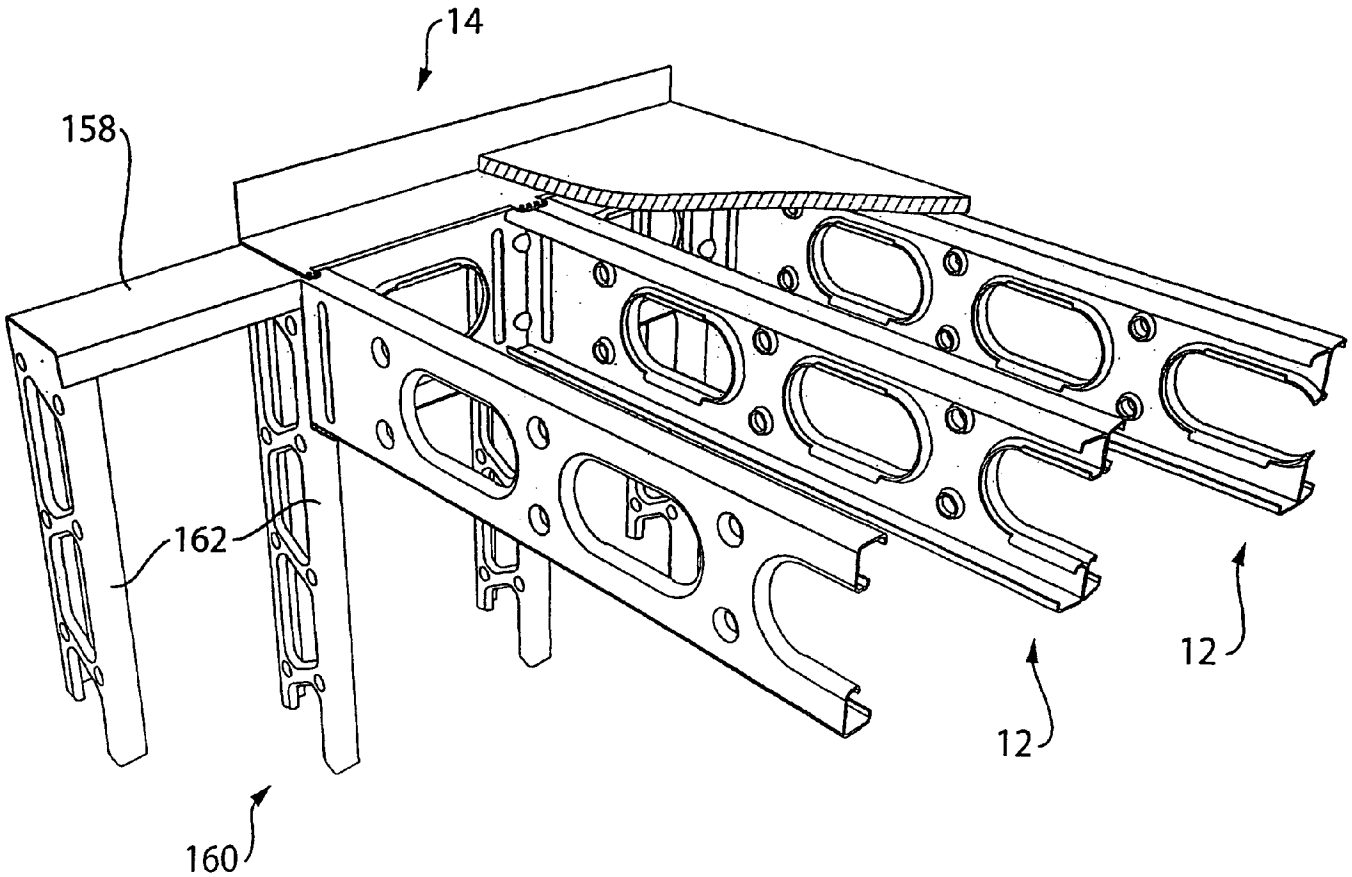
Figure 14:
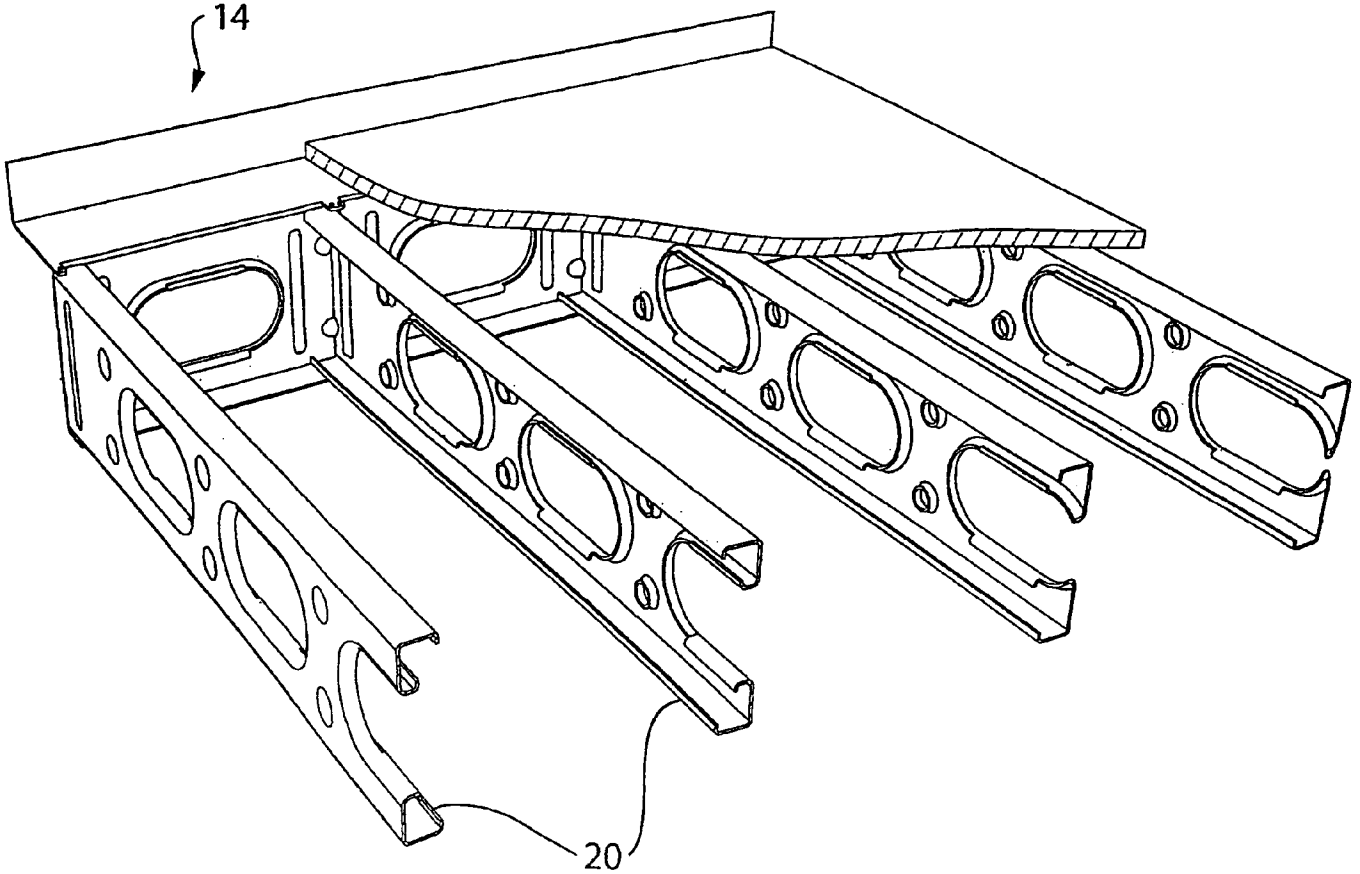
Figure 15:
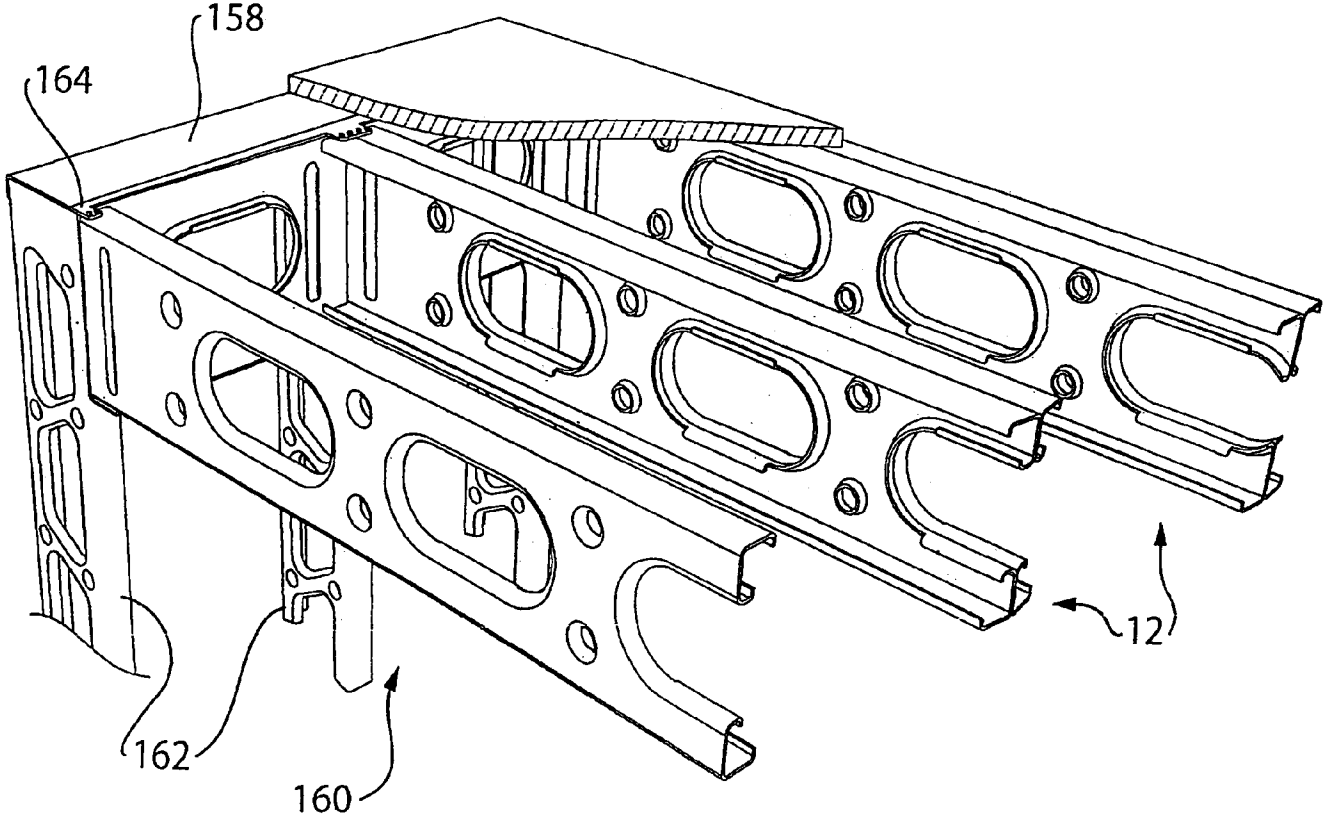
Figure 16:
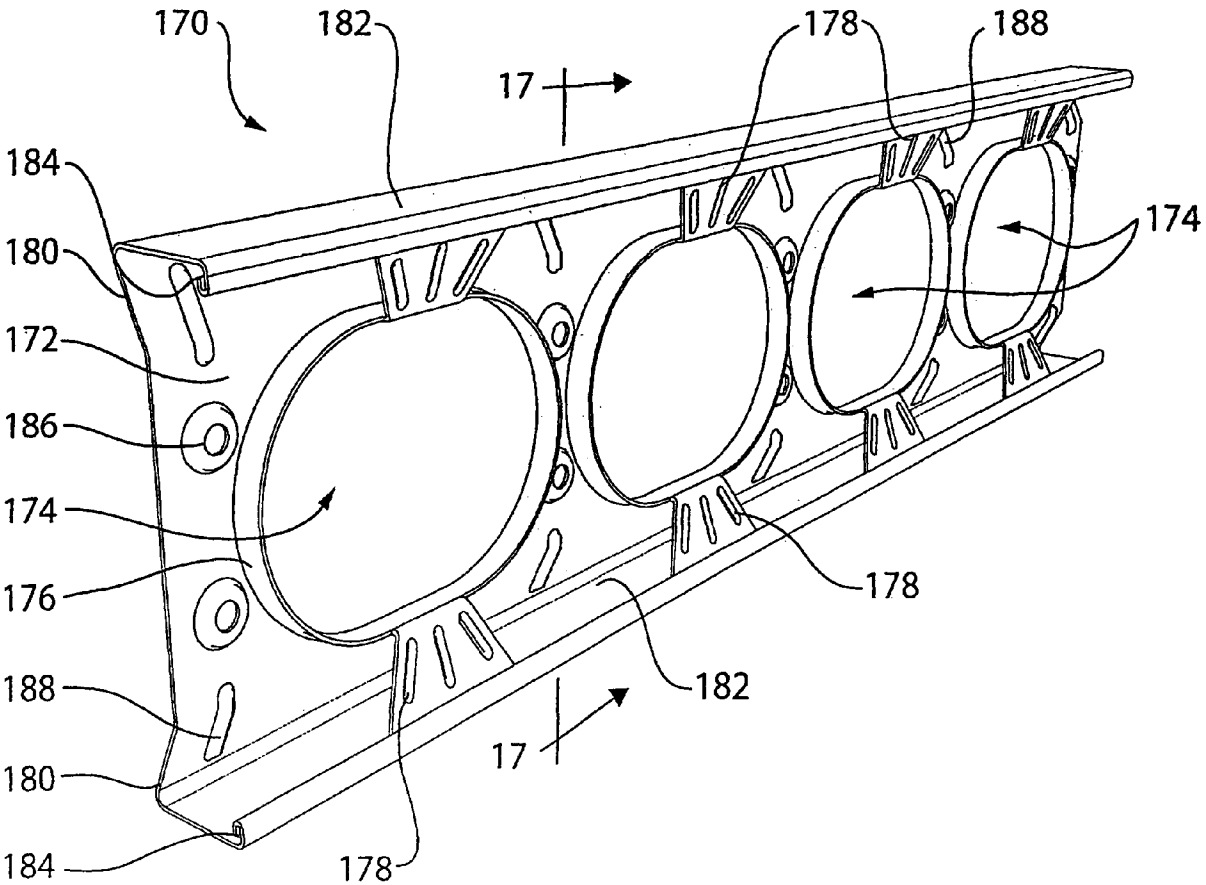

FIG. 5 section of one joist member along line 5-5 of FIG. 1;

FIG. 6 is a perspective of a rim member from the embodiment of FIG. 1;

FIG. 7 is a section of a rim member along line 7-7 of FIG. 6;

FIG. 8 is a section of a rim member along line 8-8 of FIG. 6;

FIG. 9 is a section of a rim member along line 9-9 of FIG. 6;

FIG. 10 is a perspective of a further embodiment of floor system using composite joist members illustrating another embodiment of the invention, in which the rim member is modified from FIG. 1;

FIG. 11 is a perspective of a further embodiment of floor system illustrating another embodiment of the invention, for supporting a panel floor typically of plywood, with the composite joist members modified to remove the embedment edges;

FIG. 12 is a perspective of a further embodiment of floor system illustrating another embodiment of the invention, for supporting a panel floor typically of plywood, with the rim member modified from FIG. 11;

FIG. 13 is a perspective of a further embodiment of floor system using composite joist members illustrating another embodiment of the invention, in which the rim members are supported on the edge of a wall frame formed of metal studs;

FIG. 14 is a perspective of a further embodiment of floor system using single joist members illustrating another embodiment of the invention;

FIG. 15 is a perspective of a further embodiment of floor system using composite joist members illustrating another embodiment of rim member in which the flange is of reduced width compared to FIG. 1;

FIG. 16 is a perspective of a further embodiment of a joist member; and

Figure 17:
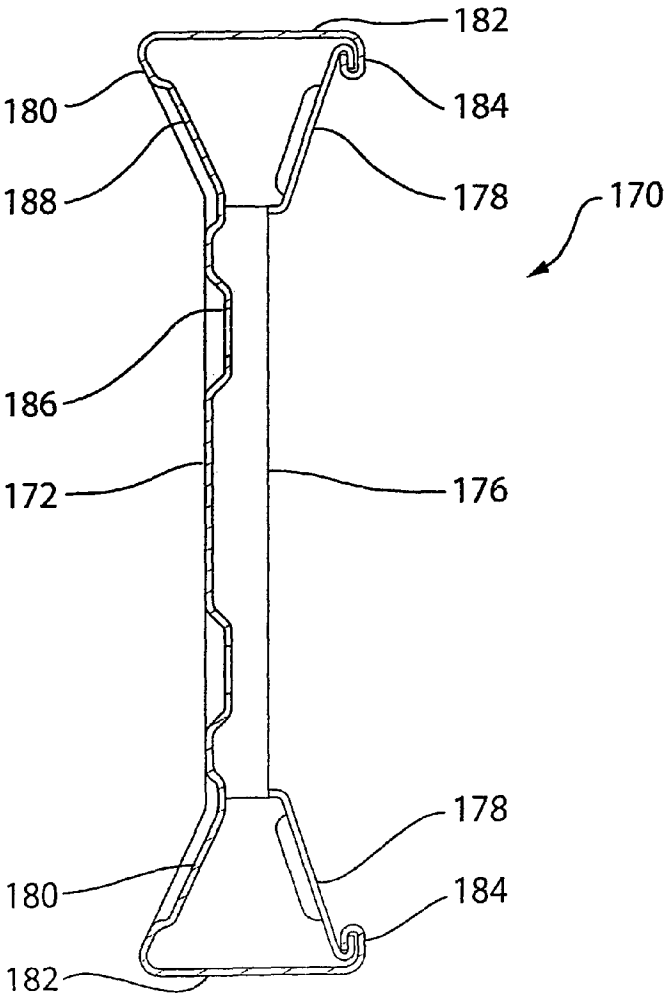

FIG. 17 is a side view of the joist member of FIG. 16.

DESCRIPTION OF A SPECIFIC EMBODIMENT

As already described the invention provides a floor system using integral one piece sheet metal steel joists, having improved acoustical performance to reduce transmission of sounds from one floor to the next. The joists are suitable for use in erecting floors, or roofs, and the like. The invention also provides integral one piece sheet metal steel joists suitable for use in reinforcement of slab concrete panel floors or roofs.

The invention also provides composite H shaped or I shaped joist members formed by joining two joists together back to back, and a method of making such a joist member, and a method of forming a floor.

For the purposes of this description the word "floor" is used to describe a level structure used in construction, which may function either as a floor for supporting persons and objects within a structure, or to a roof for enclosing a structure. When used as a roof, such a structure will usually have a slope, whereas when used as a floor it will be level. The invention is equally applicable to either function.

Referring to FIG. 1 it will be seen that the invention is there illustrated in the form of a floor (10). Typically the floor (10) made up of composite sheet metal joist members (12), and integral one piece sheet metal steel rim members (14). Typically the rim members (14) are supported on the upper edge of a wall, not shown, or a basement or other structure. The joist members (12), span the space surrounded by the rim members (14, and the joist members (12) are supported at their ends on the rim members (14)

As shown in FIG. 1 the composite joist members (12) in this embodiment are composites made up of two identical joists (20), placed back to back. In this way the composite joist member forms an H shape or I shape member. Each joist (20) is an integral one piece sheet metal steel member, formed of a single integral piece of sheet steel. Each joist (20) has a web (22) which is essentially planar, and an edge flange (24) along the lower side edge of the web (22). Edge flange (24) is formed by bending the web at right angles. A lip (26) are formed on the edge flange (24) again at right angles.

In the web (22) main openings (28) are formed by punching out a portion of the sheet metal, and by displacing but not removing other portions of sheet metal as will become apparent below.

In this embodiment the main openings (28) are formed in a generally oval shape elongated along the length of the joist (20). The openings are identical and symmetrical for reason to be described. Each opening (28) has opposite ends (30) located along the central axis of the web (22) with a semi-circular or arcuate profile.

Between the ends (30) along opposite sides, the openings (28) are formed with elongated linear parallel sides as at (32).

Figure 2:
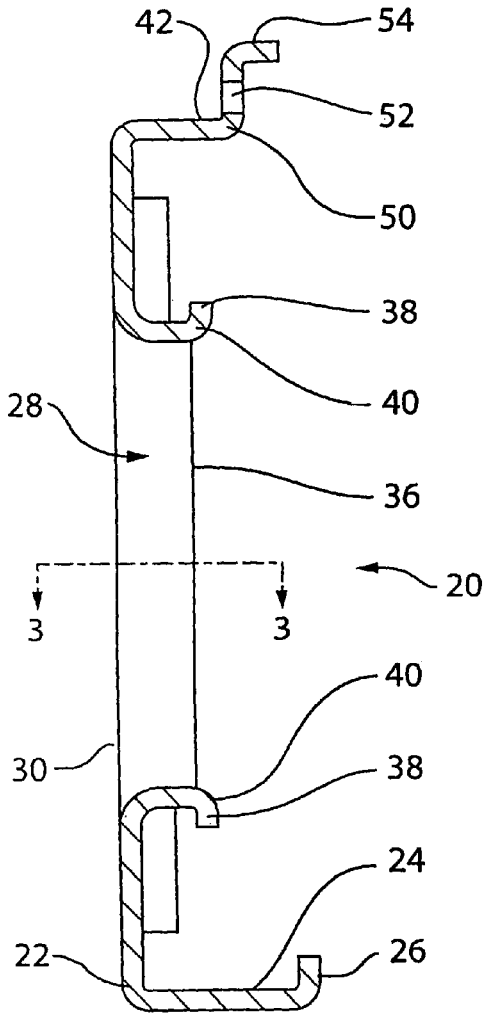
FIG. 2 is a section of one joist member along line 2-2 of FIG. 1.
Figure 3:
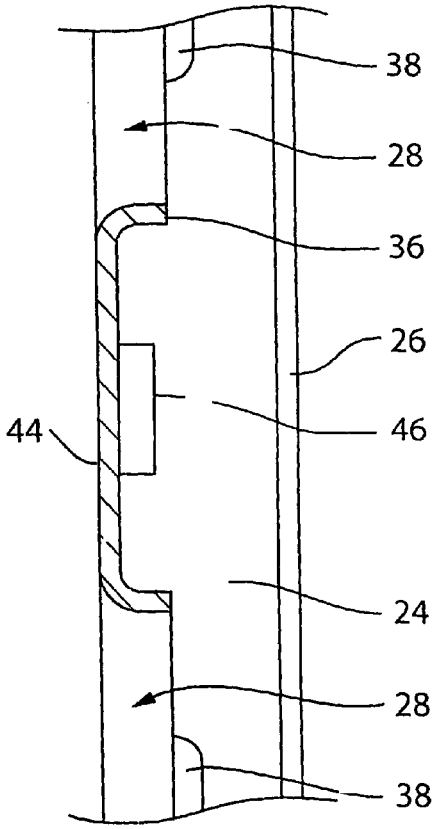
FIG. 3 is a section of one joist member along line 3-3 of FIG. 1.
Figure 4:
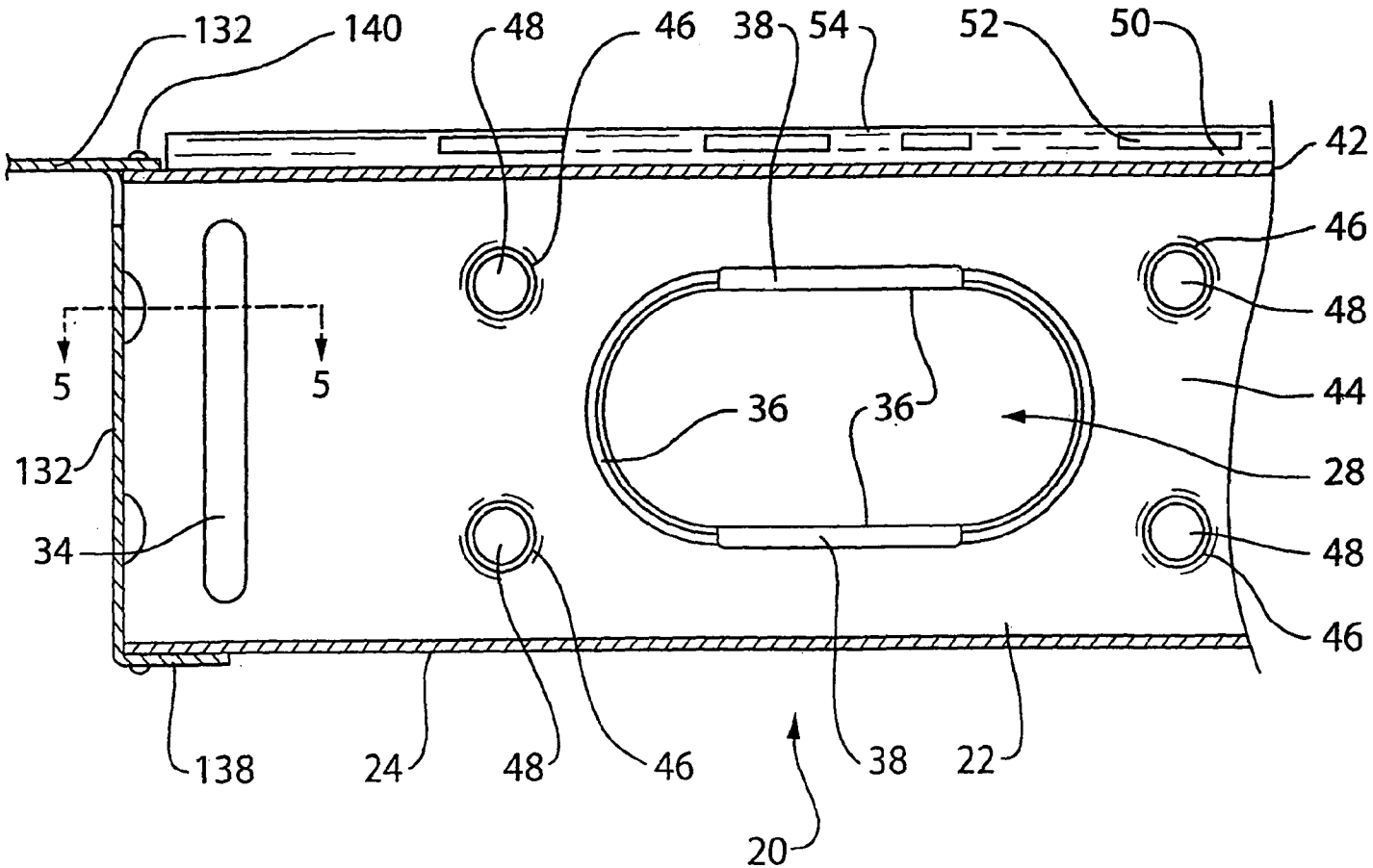
FIG. 4 is a side elevation of a portion of one joist member of FIG. 1, with parts shown in section.

Elongated transverse ribs (34) may be formed in the web if desired, at the ends of the joists, (FIGS. 2 and 3), to provide greater rigidity at the joist ends for reasons described below.

Extending all around opening (28) there is an edge flange (36) formed at right angles to the web (22). Along the two linear sides (32) of the opening there is are reinforcing channels (38), extending integrally from the web. Channels (38) are formed by channel portions of the web (22) which have been partly punched out and displaced, but which remain joined integrally to the web, along such linear sides of the openings (28). Reinforcing channels (38) are formed by making a first right angle bend (40*a*) and a second right angle bend (40*b*) parallel to but spaced from the plane of the web (22).

In this way the channel portions form short U shaped reinforcement channels (38), extending from the web, along the two opposed parallel linear sides (32) of the openings (28). In this way reinforcing channels (38) greatly reinforce the joist (20) along the length of the two linear sides (32) of openings (28).

This feature permits the openings (28) to be formed with relatively large dimensions, so that a conduit, not shown, can extend through opening (28) and is limited only by the transverse dimension of the opening transversely across the web (22). This is a great improvement over joists having triangular openings. A junction flange (42) (described below) may be formed along the upper side of the web (22), for reasons described below.

It will be noted that the shape and placement of the openings (28) defines struts (44) extending transversely across the web (22). Such struts reduce the transfer of sounds across the joist. Joists (20) are further formed with depressions (46) at opposite ends of each strut (44) where the strut flares out into the web (22). Centered in such depressions (46) there are punched out strut openings (48), which in this case are circular, although they could be other shapes. The strut openings (48) remove metal and this provides a better barrier to conduction of sound across the joist and improve its acoustical performance. This embodiment of joist is particularly advantageous. It has great strength due to the retention of a considerable amount of the metal displaced by blanking the openings (28). A large part of such metal is not removed but is retained and is formed with two spaced apart right angle bends outwardly to form the reinforcing channels (38) formed along both sides of each main opening (28).

FIGS. 1 to 6 illustrate another feature of joist (20) for embedment in a concrete slab. In this embodiment the joist incorporates an edge portion of the web which is bent outwardly for embedment in a concrete slab.

For this purpose junction flanges (42) are formed along one edge of the web. The opposite edge of the web will be left with its basic right angle flange (24), unchanged. Junction flanges (42) are formed with embedment edge strips (50) which are bent out of the plane of the web by about 45 degrees. The angle can vary somewhat for various applications.

Strips (50) are formed with a series of openings or ports (52). These openings enable concrete to flow through and around strips (50) and thus set as an integral slab.

A locking lip (54) is formed along strip (50) for locking into the concrete. Thus this embodiment provides a joist of great strength providing reinforcement for a concrete floor slab or panel. The strips (50) being partially embedded in concrete will provide maximum security of adhesion between the joists and the concrete.

This joist may enable the use of a reduction in thickness of sheet metal. It is anticipated that a reduction of at least one gauge and probably two gauges can be achieved while still providing adequate support to a concrete floor slab or panel.

This will reduce the cost of the floor slabs or panels.

FIG. 9 shows a further form of joist (100) having features which make it suitable for supporting floors made of other panel materials, such as plywood or the like. Joist (100) has a web (102) and identical edge flanges (104) and (106) along either side of the web. Lower and upper edge flanges (104) and (106) are identical and are bent at a right angle to the plane of the web. Integral lips (108) extend from flanges (104) and (106) parallel to the plane of the web.

Ribs (110) are formed as before transversely of the joists (100)

Main openings (112) are formed through web (102) as before, being of generally elongated oval shape in the FIG. 1 embodiment.

Edge flanges (114) are formed around main openings (112) as before. Linear side edges (116) and (118) of openings (112) are reinforced by reinforcement channels (120) formed from channel portions of sheet metal, extending integrally from web (102), thus retaining more of the metal displaced by forming the opening (112) and employing it to improve the joist, rather than discarding it as waste.

The channel portions forming channels (120) are folded at first and second right angular bends, thus providing the reinforcement channels extending along each linear side of opening (112), provide greater strength. More metal is retained in the joist, which both increases its strength, or in the alternative permits a reduction in gauge. Strut depressions, (122) with openings (124) which may be circular or other shapes are formed in the web, as described above to aid in reducing heat losses.

In use two such joists (20) or (100) are juxtaposed as shown in FIGS. 1 and 9, in back to back relation. They may be secured together, if desired, by eg spot welds or the like (not shown) to form a composite joist member.

Manufacture of the joists (20) or (100) can proceed by first forming the openings (112) and rim flanges (114) in a suitable press. This can be a flying die press, of a type well known in the art. However it is advantageous to use a rotary press of the type which has two rotary die support rolls, and dies on the support rolls, in which the two support rolls rotate bringing the dies together and apart as the sheet metal moves between them.

After blanking and forming of the openings and forming of the edge flanges around the openings, and the forming of the depressions and punching of the depression openings, the semi-formed sheet metal is then passed through a series of roller die stands, such as are known per se and require no description. The roller dies on the die stands will progressively form the edge flanges (24) or (104, 106) and the reinforcing channels (38) or (120) on either side of the main openings.

Cutting to length may be performed upstream of the rotary press where the strip sheet is still flat and unformed. In this way each piece of sheet metal passing through the various punching and forming and roll forming sequences is already precut to the exact length required for the finished joist.

It also possible to cut the joists to length downstream of the roller dies, depending on the design of the equipment.

It must be remembered that in cutting to length, provision must be left at each end of each joist to leave end portions of the joist free of openings, so that in can be supported in place in an eventual floor structure, with all of the openings in each joist aligned with one another across the structure. In the case of joists (20) and (100) this is greatly facilitated by the fact that the openings (28) and (112) are identical and symmetrical and are separated by transverse ribs Cutting to length is rendered easier by this form of joist. When the two joists are placed back to back, with the openings in registration with each other, it will be apparent that this will greatly facilitate the installation of services through the openings.

In order to assemble the composite joist members (12) into a floor, a rim member (14) is provided, as shown in more detail in FIGS. 11 and 12.

The rim member (14) has a web (130) and a top flange (132) extending at right angles.

Flange (132) is intended to lie on top of a wall or basement structure.

Flange (132) may have an upstanding edge wall (134), or an downwardly bent edge wall (136) turned down to lock on to the outside of a wall.

Along the lower edge of web (130) a support flange (138) extends at right angles, to support the ends of the composite joist members (12).

In order to secure the joist member in position, tabs (140) are struck out of web (130) and extend in parallel spaced relation over support flange (138). In the embodiment shown the tabs (140) are located in the same plane as the flange (132). In this way the upper horizontal surfaces of junction flanges (42) of the joist members (12) will lie coplanar with the flange (132). In the case of the embodiment of FIG. 1 the embedment edges (50) of the joist members will extend above such a plane, and this is intended so that a concrete floor slab may be poured which extends over flanges (132) of rim member (14).

When the joist members (12) are to be attached to the tabs (140) a short portion of the embedment flange will be removed at the ends of the joist members (12). This will enable the junction flanges (42) to fit beneath the tabs (140) and secured thereto by fasteners. Fasteners will also be used to secure the edge flange (24) to the support flange (138) of the rim member (14).

In the case of a poured concrete floor, the flange (132) of the rim member (14) is formed with embedment loops (142) struck out of the flange. The poured concrete will flow around such loops (142) and will thus secure the rim member (14) in position.

In the case of a panel floor, of plywood for example, the flange (132) of the rim member (14) is formed flat without any such loops. This enables such a panel floor to be laid flat on the upper flanges (106) of joists (100), and then to lie flat on the flanges (132) of the rim member (14).

Since in this case the upper flange (106) is planar, it will fit beneath the tabs (140) without requiring the removal of any portion.

It will be understood that in many cases there may be only two such rim members (14) parallel and spaced apart on opposite walls for supporting joist members (12) spanning the area. For additional stiffness, if desired, abutments (144) may be formed in the web (130). These abutments are spaced apart so as to engage the opposite sides of the composite joist members, at each end. The webs (130) are also formed with generally oval shaped openings (146) similar to the joists, and edge flanges (148) and lips (150) are formed therearound as before.

Vertical ribs (152) are formed in web (130) for adding stiffness.

In this case single joists (20) or (100) (FIG. 1 and FIG. 6) alongside the extreme edges of the floor may themselves lie on top of the wall.

In other cases there may be four such rim members (14), or even more, depending on the area to be enclosed by a floor.

Intermediate rim members (14) supported above a floor by any suitable means may be required to span a greater area, of the cover in a space of a special shape in plan.

The joists and rim members may be associated together in accordance with the method described. Preferably the assembly of the rim members and joists, and also the pouring of concrete in some cases, will be done in a factory the building site. The floor can be prefabricated in sections. When transported to the site the floor sections or panels will simply be lifted into place and fastened together to form the complete floor in the building.

Various embodiments are proposed with variations for different applications. Thus FIG. 10 is a perspective of a further embodiment of floor system using composite joist members illustrating another embodiment of the invention, in which the rim member is modified from FIG. 1. In this case the edge flange (136) is shown turned down.

FIG. 11 is a perspective of a further embodiment of floor system illustrating another embodiment of the invention, for supporting a panel floor typically of plywood, with the composite joist members modified to remove the embedment edges. In this case the composite joist members are the same as in FIG. 1 but the embedment edges are removed and replaced by a flange similar to lower flange (24). This enables plywood or other panel to be laid flat on the composite joist members. The rim member is also modified to remove the embedment loops and present a flat upper surface.

FIG. 12 is a perspective of a further embodiment of floor system illustrating another embodiment of the invention, for supporting a panel floor typically of plywood, with the rim member modified from FIG. 11. In this case the edge flange (136) is shown turned down.

FIG. 13 is a perspective of a further embodiment of floor system using composite joist members illustrating another embodiment of the invention, in which the rim members are supported on the edge of a wall frame formed of metal studs. The panels are of plywood or the like and thus the composite joist members do not have embedment edges. This is shown supported on the upper plate of a wall frame. The wall frame is also formed of metal studs, which are distinct from the composite joist members.

FIG. 14 is a perspective of a further embodiment of floor system using single joist members. In this case the joist members have the same features as the joist members (20) of FIG. 1, but are used singly, and not fastened back to back. FIG. 15 is a perspective of a further embodiment of floor system using composite joist members illustrating another embodiment of rim member in which the flange is of reduced width compared to FIG. 1. In this case it is possible to reduce the width of the flange of the rim member. This is possible because the rim member is already supported on the plate channel of the wall frame. The rim member is otherwise similar to the rim member of FIG. 1.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An integral one piece sheet metal steel joist for use in floor systems, formed of a single integral piece of sheet steel, and comprising;

a web defining first and second edges and an axis, and first and second web side surfaces;

an edge wall on at least one of said first and second edges of the web, bent at a right angle and extending from said first web side surface;

identical symmetrical main openings formed through said web at spaced intervals therealong, of predetermined size and profile, with rounded ends and linear sides parallel to one another;

channel portions of said web around said openings remaining attached integrally to said web along opposite linear sides of the opening;

reinforcing channels formed from said channel portions extending along each of the two opposite linear sides of said main openings and defining a first right angle channel bend formed in each said channel portion, whereby said channel portion is displaced from said first web side surface, and a second right angle channel bend formed in each said channel portion parallel to and spaced from said first channel bend, said first and second right angle channel bends being formed along axes parallel to one another and parallel to said web axis;

intermediate walls formed from said channel portions extending between said first right angle channel bend and said second right angle channel bend, whereby to form said channel portions into generally U-shaped right angular channel sections extending out from said first side surface of said web, whereby said second side surface of said web remains smooth and free of obstructions;

depressions formed in said web at spaced intervals, extending from said first side surface of said web; and, depression openings formed in said depressions to reduce sound transfer through the joist.

2. An integral one piece sheet metal steel joist as claimed in claim 1 wherein there are two said edge walls one on each edge of said web, being formed normal to said web, and lips formed along said edge walls normal to said edge walls.

3. An integral one piece sheet metal steel joist as claimed in claim 1 wherein said main openings are identical and symmetrical, and are arranged in uniform aligned orientation and define between them transverse struts extending transversely across said web.

4. An integral one piece sheet metal steel joist as claimed in claim 3 wherein said depressions and depression openings are formed in said web at opposite ends of each said strut.

5. An integral one piece sheet metal steel joist as claimed in claim 4 including an embedment flange formed on a said edge on said one side of said web extending from said first side surface of said web whereby to permit embedment in a concrete panel.

6. An integral one piece sheet metal steel joist as claimed in claim 5 wherein said embedment flange is formed with openings for flow of concrete therethrough, and a locking strip is formed along said embedment flange.

7. A composite joist formed of two integral one piece sheet metal steel joists each said joist comprising;

a web defining first and second edges and an axis, and first and second web side surfaces;

an edge wall on at least one of said first and second edges of the web, bent at a right angle and extending from said first web side surface;

identical symmetrical main openings formed through said web at spaced intervals therealong, of predetermined size and profile, with rounded ends and linear sides parallel to one another;

channel portions of said web around said openings remaining attached integrally to said web along opposite linear sides of the opening reinforcing channels formed from said channel portions extending along each of the two opposite linear sides of said main openings and defining a first right angle channel bend formed in each said channel portion, whereby said channel portion is displaced from said first web side surface, and a second right angle channel bend formed in each said channel portion parallel to and spaced from said first channel bend, said first and second right angle channel bends being formed along axes parallel to one another and parallel to said web axis;

intermediate walls formed from said channel portions extending between said first right angle channel bend and said second right angle channel bend whereby to form said channel portions into generally U-shaped right angular channel sections extending out from said first side surface of said web, whereby said second side surface of said web remains smooth and free of obstructions;

depressions formed in said web at spaced intervals, extending from said first side surface of said web;

depression openings formed in said depressions to reduce sound transfer through the joist, and wherein said two joists are arranged back to back with their respective second side surfaces in contact with one another, and with their edge walls extending away from one another, and with their main openings registering with one another to form a composite joist member.

8. A floor system for supporting a floor and comprising;

a plurality of composite steel joist members each made up of two integral one piece sheet metal steel joists, each said steel joist in turn comprising;

a web defining first and second edges and an axis, and first and second web side surfaces;

an edge wall on at least one of said first and second edges of the web, bent at a right angle and extending from said first web side surface;

identical symmetrical main openings formed through said web at spaced intervals therealong, of predetermined size and profile, with rounded ends and linear sides parallel to one another;

channel portions of said web around said openings remaining attached integrally to said web along opposite linear sides of the opening;

reinforcing channels formed from said channel portions extending along each of the two opposite linear sides of said main openings and defining a first right angle channel bend formed in each said channel portion, whereby said channel portion is displaced from said first web side surface, and a second right angle channel bend formed in each said channel portion parallel to and spaced from said first channel bend, said first and second right angle channel bends being formed along axes parallel to one another and parallel to said web axis;

intermediate walls formed from said channel portions extending between said first right angle channel bend and said second right angle channel bend, whereby to form said channel portions into generally U-shaped right angular channel sections extending out from said first side surface of said web, whereby said second side surface of said web remains smooth and free of obstructions;

depressions formed in said web at spaced intervals, extending from said first side surface of said web;

depression openings formed in said depressions to reduce sound transfer through the joist, at least two rim members, each said rim member in turn comprising;

a web, and a support flange extending from said web at right angles;

a top flange for engaging a wall structure;

a plurality of tabs displaced from said web for attachment to respective said composite joist members.

9. A floor system for supporting a floor as claimed in claim 8 wherein said composite joist members are formed with embedment flanges and locking strips along one of their sides, and wherein a portion of said embedment flanges and locking strips are removed adjacent said tabs, to facilitate interconnection with said tabs.

10. A floor system for supporting a floor as claimed in claim 9 wherein said rim member is formed with abutments for engaging sides of said composite joist members.

11. A floor system for supporting a floor as claimed in claim 10 wherein said rim members incorporate an upstanding edge flange.

12. A floor system for supporting a floor as claimed in claim 11 wherein said rim members incorporate a downward edge flange.

13. A floor system for supporting a floor as claimed in claim 12 wherein said top flanges of said rim members incorporate upstanding embedment loops.

14. A floor system for supporting a floor as claimed in claim 9 wherein said joist members and said rim members are assembled into a prefabricated panel ready for delivery to a building site.

15. A floor system as claimed in claim 14 and including an embedment flange formed on a said edge flange on said one side of said web whereby to permit embedment in a concrete panel, and a concrete slab poured and set embedding said embedment flanges.

16. A method of making a composite steel joist member formed of two steel joists each having a web and side edges, and a flange along at least one said side edge, and main openings through said web, said method comprising the steps of;

forming individual joists of sheet steel, having a web, and edges, and first and second side surfaces;

forming main openings in said web of identical shape and symmetrically spaced along said web at spaced intervals therealong, with channel portions of said web being displaced from said main openings leaving two said channel portions attached to said web, and, forming said channel portions by bending said channel portions at right angles, along first and second bend lines parallel to the web axis, to define reinforcing U-shaped rectangular channel shapes in section;

forming struts extending transversely across said web between said main openings;

forming depressions and depression openings in said web adjacent each end of each strut; and, arranging said two joists back to back with their openings in registration with one another and fastening them together.

* * * * *